United States Patent [19]

Schleicher et al.

[11] 4,326,467

[45] Apr. 27, 1982

[54] PALLET FORMED OF FOLDED PROFILED METAL SHEET

[75] Inventors: Hermann Schleicher, Erlangen-Rathsberg; Norbert Vogel, Erlangen, both of Fed. Rep. of Germany

[73] Assignee: Hermann Schleicher GmbH & Co., Erlangen, Fed. Rep. of Germany

[21] Appl. No.: 128,589

[22] Filed: Mar. 10, 1980

[30] Foreign Application Priority Data

Mar. 9, 1979 [DE] Fed. Rep. of Germany ..... 2909206

[51] Int. Cl.[3] ..... B65D 19/22

[52] U.S. Cl. ..... 108/51.1; 108/56.1

[58] Field of Search ..... 108/51.1, 51.3, 53.1–57.1; 206/386, 596–600; 220/1.5

[56] References Cited

U.S. PATENT DOCUMENTS

| | | | |
|---|---|---|---|
| 1,359,138 | 11/1920 | Wine | 108/51.1 |
| 1,748,621 | 2/1930 | Schmoldt | 108/51.1 |
| 2,256,750 | 9/1941 | Reimenschneider | 108/51.1 |
| 2,958,494 | 11/1960 | Lovegreen | 108/51.3 |
| 2,970,797 | 2/1961 | Desbois | 108/51.3 |
| 3,093,216 | 6/1963 | Dunham | 108/51.1 |
| 3,172,374 | 3/1965 | Allen | 108/51.1 |

FOREIGN PATENT DOCUMENTS

| | | | |
|---|---|---|---|
| 313777 | 8/1969 | Sweden | 108/51.3 |
| 1246854 | 9/1971 | United Kingdom | 220/1.5 |

*Primary Examiner*—William E. Lyddane

*Attorney, Agent, or Firm*—Schuyler, Banner, Birch, McKie & Beckett

[57] ABSTRACT

A pallet is provided from a single profiled metal sheet which has the opposite edges folded inwardly several times along bend lines that extend transversely to profiled grooves of the sheet so as to form hollow girders having perpendicular supporting walls along the pallet edges. The sheet is provided along the bend lines and in accordance with the configuration of the profiled grooves with rows of recesses having associated slots to accommodate folding of the profiled sheet into the hollow girders.

5 Claims, 13 Drawing Figures

PALLET FORMED OF FOLDED PROFILED METAL SHEET

This invention relates to a pallet constructed from profiled metal sheet for storing and conveying piece goods capable of being stacked.

Pallets are known (U.S. Pat. No. 2,306,752) which consist of a plurality of profiled bottom and cover plates spaced a distance by special profiled supporting wall have short bent-aside legs and engage the profiling of the top and bottom plates with which they are fixedly connected through spot welding. The top and bottom plates forming the loading and base surfaces of the pallet constitute with the supporting walls arranged perpendicularly thereto box-type hollow girders which extend over the entire width of the pallet.

Pallets are also known (U.S. Pat. No. 1,359,138) which are made up of various individual narrow skid-type bent-aside parts and have special vertical stirrups at the four corners of the pallet. Pallets are further known (U.S. Pat. No. 2,290,715) which consist of a base plate on whose edges special supports holding individual vertical stirrups are flange-mounted.

Such pallets require a large quantity of material and very elaborate and costly construction procedures, since they consist of many individual parts.

It is the object of the invention to make a pallet with box-type hollow girders from a single alternately bent profiled plate having a high breaking strength and which is very easy to make with a small quantity of material and has very advantageous loading and base surfaces.

According to the invention, the pallet consists of a single profile plate which is bent inwardly several times along bending lines extending transversely to the profile grooves of the plate so as to form hollow girders having perpendicular supporting walls provided along the bending lines and provided in accordance with the design of the profile grooves with rows of recesses and slots.

Every three bending lines lie on opposite border zones of the plate and are folded inwardly on both sides into rectangular closed hollow girders each having an inner supporting wall and an outer supporting wall.

Further advantageous developments are set forth in the attached claims.

The pallets embodying the principles of the invention can be transported by fork lifts or similar devices and can be stacked into one another when empty.

The invention will be explained with reference to preferred embodiments of the invention shown in the drawings, wherein.

Figure 1:
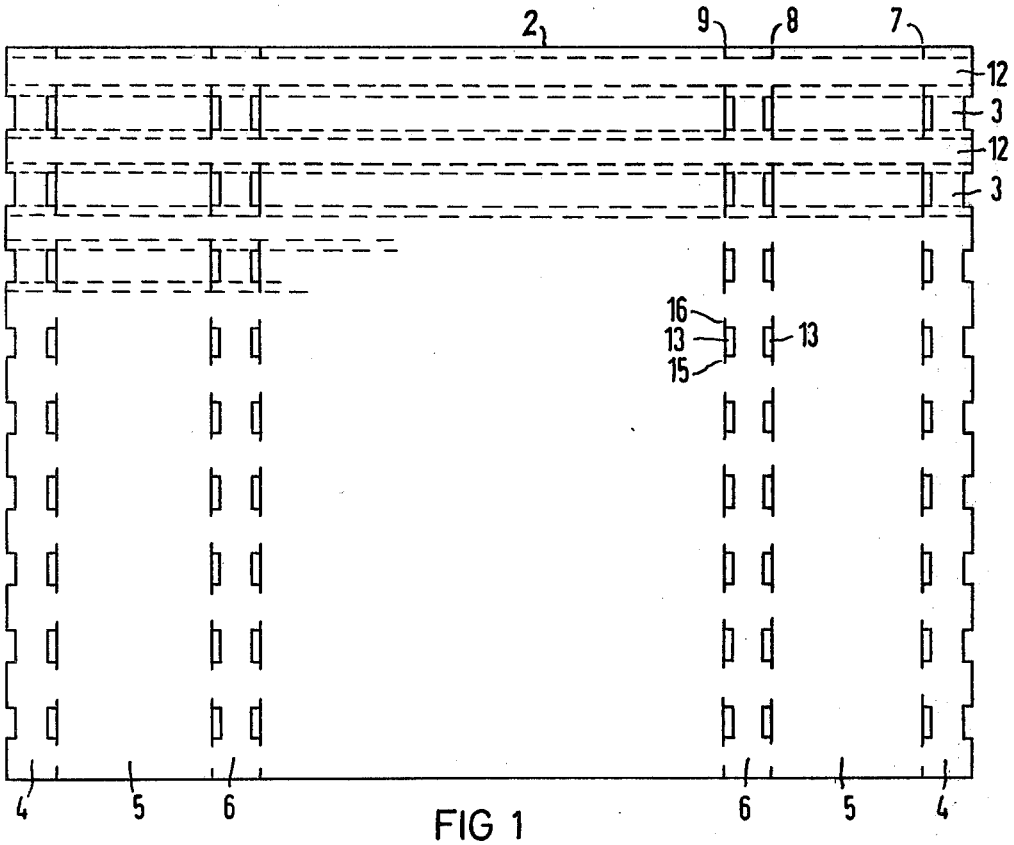
FIG. 1 is a plan view of the initial metal sheet prior to profiling and bending of the border areas.

Pallet 1 consists of a single rectangular plate 2, e.g. from steel, with transverse U-shaped grooves 3. FIG. 1 shows the initial plate 2 prior to profiling and bending of the border zones.

Figure 2:
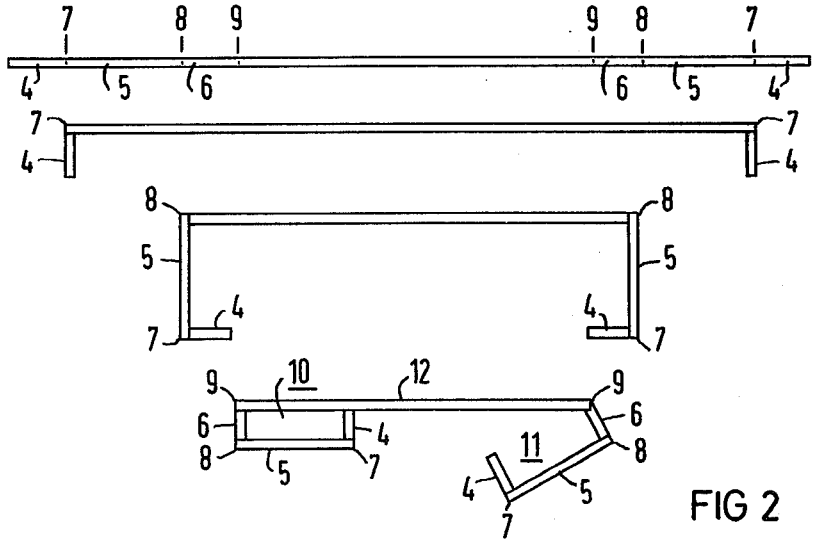
FIG. 2 is a side view of the individual stages of the bending.
Figure 4:
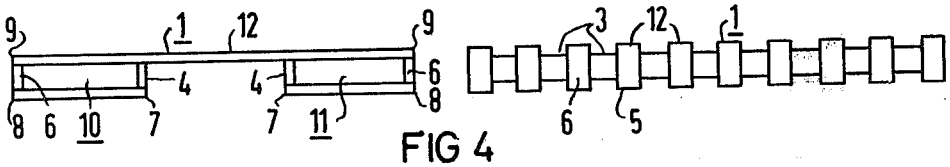
FIG. 4 is a side view from the front with the bilateral hollow girders and a side view of the profile of the longitudinal side.
Figure 5:
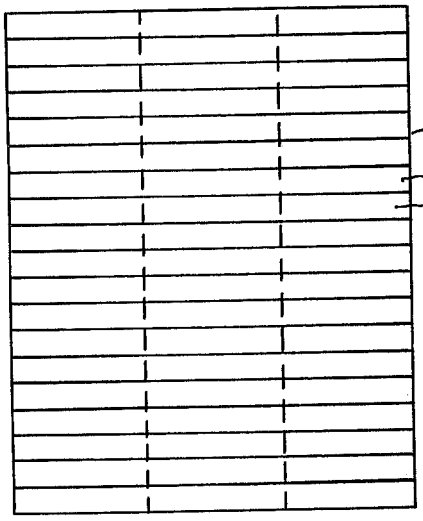
FIG. 5 is a plan view of the pallet with profile.
Figure 3:
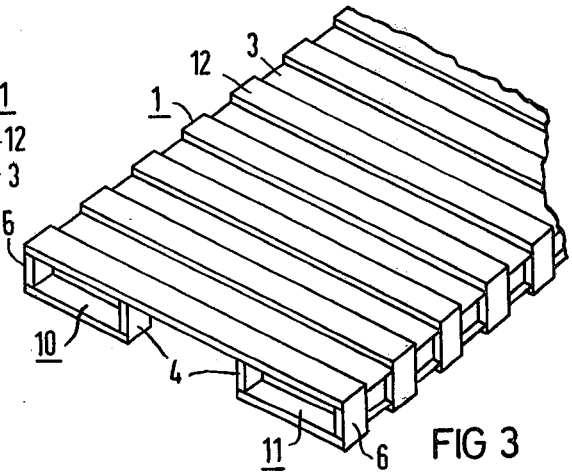
FIG. 3 is a perspective view of the pallet.

As shown in FIG. 2, the bilateral border zones 4, 5, 6 are each inwardly folded three times by 90° so as to form the edges 7, 8, 9. This results in the formation, on both sides, of a closed longitudinal box-type hollow girder (10, 11) in which the supporting arms of a fork lift can engage. Parts 4 and 6 form inner and outer supports or posts. Parts 4 thus constitute the inner supporting walls and parts 6 the outer supporting walls of the two hollow girders 10 and 11. Parts 4 and 6 are arranged perpendicularly to the base area 5 and the loading area 12. All the parts 5 of the profiling form the base area on both sides. All the remaining upper surface 12 of the profiling constitutes the loading area. This may also be provided with an additional fine-profiling so as to improve stability further.

The width of the bilateral hollow girders 10 and 11 shall be $\frac{1}{3}$ of the total width of the loading area 12.

Trapezoidal grooves may likewise be provided, whose webs have a steep angle e.g., 80°.

As shown in FIGS. 1, 6 to 8 and 9, 10, in order to enable the folding of the border zones 4, 5, 6, along the principles of the invention, transversely to the U-shaped profile grooves 3 to form the follow girders 10, 11, the profiled plate is provided at the bending lines 7, 8, 9 to be made along the width and height of the U-profile 3 with rows of rectangular recesses 13.

Figure 8:
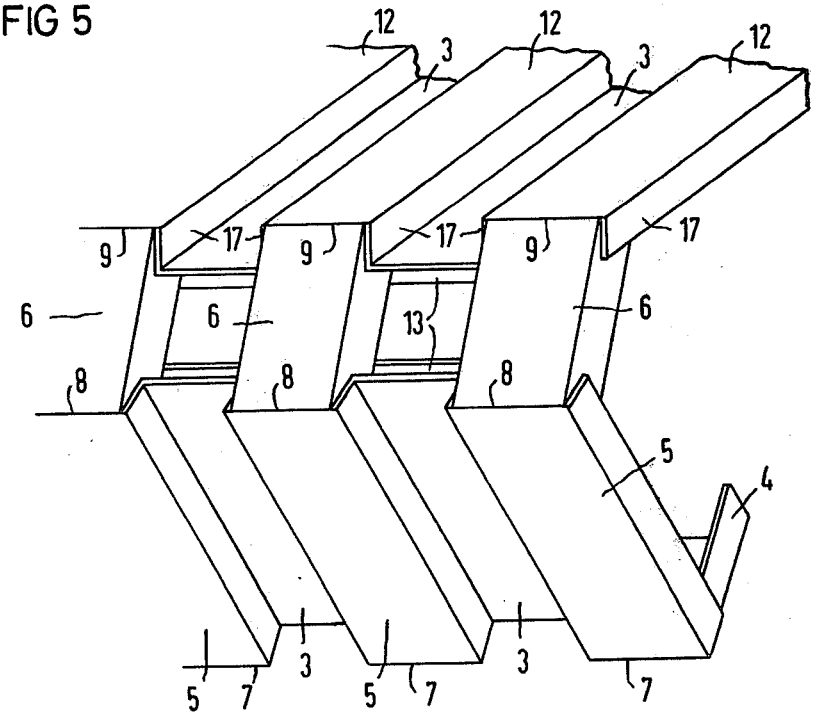
FIG. 8 shows a perspective view of the bending procedure.
Figure 6:
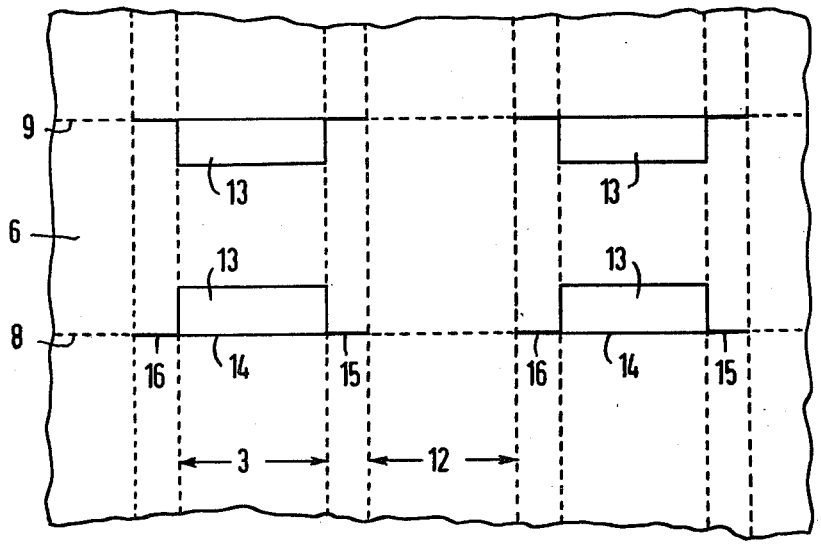
FIG. 6 is a partial plan view of the initial plate with recesses.
Figure 7:
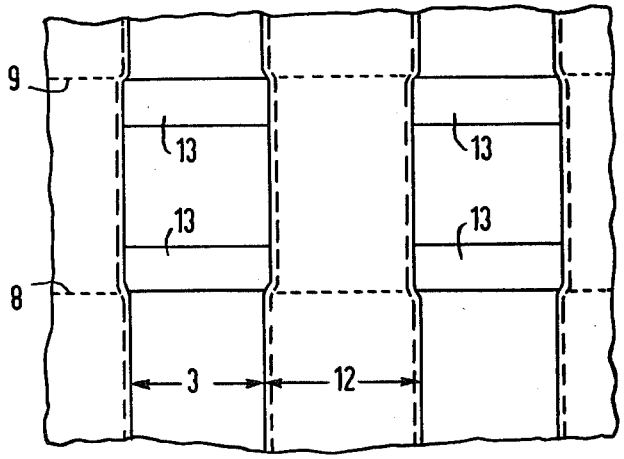
FIG. 7 is a plan view of FIG. 6 after profiling.

As apparent from FIGS. 1 and 6, the longitudinal sides 14 of the recess 13 extending along the bending lines 8, 9 are extended on both sides by slots 15, 16 in accordance with the shape and height of the web of the profiling. In this way, during the bending of the profile, web 17 formed by the slots 15, 16 on the bending lines 8, 9 can lie down over the web of the posts or supporting walls 6, 4 (FIG. 8). FIG. 6 shows plate 2 in its initial form, while in FIG. 7 it is shown with profiling. The thickness of the metal sheet is shown by the broken line.

Figure 10:
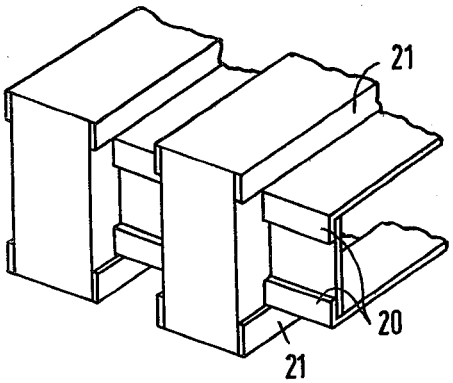
FIGS. 10 and 12 show the shapes of the stiffeners in accordance with FIGS. 9 and 11.
Figure 9:
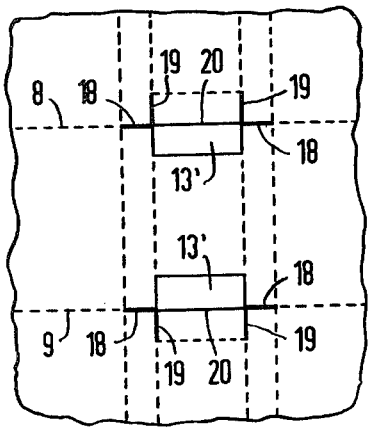
FIGS. 9 and 11 are further shapes of recesses in the initial plate.

Another preferred embodiment is shown in FIGS. 9 and 10, wherein the recesses 13' are each provided with two slots 18, 19 on one side above and below, so that tabs 20 and 21 can be turned down to provide further stiffening.

Figure 12:
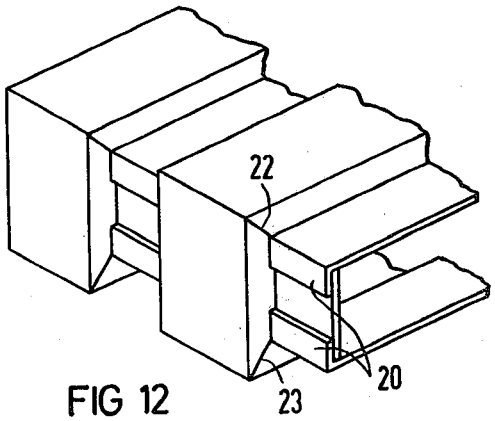
Figure 11:
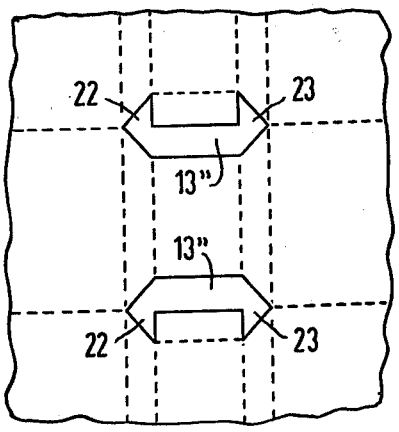

In FIGS. 11 and 12 there are provided recesses 13'' in the width of the groove and having on both sides a roof-shaped cutout configuration 22, 23. This results in the stop angle required for abutting the edges of cutouts 22, 23, since the roof-shaped cutouts 22, 23 are beveled. Also, greater strength results from the turned-down tabs.

Figure 13:
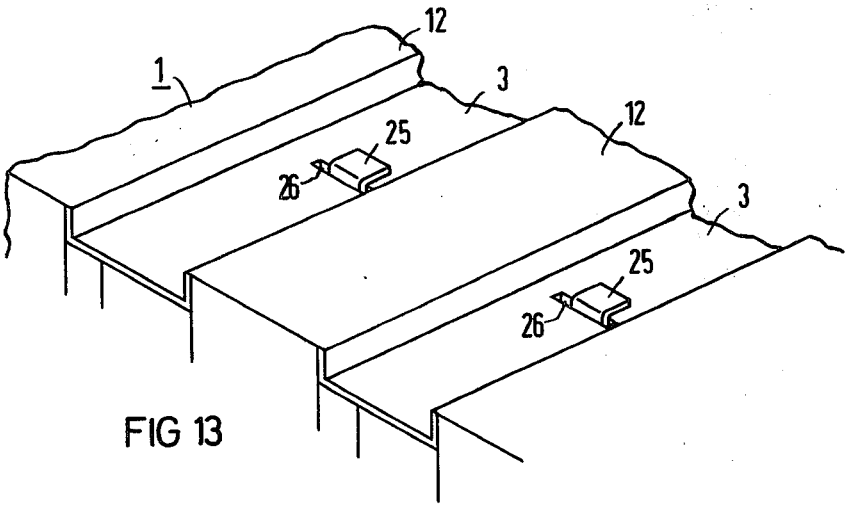
FIG. 13 shows the mounting of the inner supports.

As shown in FIG. 13, the inner support parts 4 may likewise be secured with a turned-down tab 25 extending through a recess 26 in groove bottom 3.

What is claimed is:

1. A pallet providing a loading area carried by box-type girders extending along beneath the opposite borders of the loading area comprising:

a single profiled metal sheet formed to have a transverse cross section defining parallel grooves spaced by surface areas which form the loading area for the pallet, each of the opposite borders of said profiled sheet having a folded hollow girder formed by said sheet being folded inwardly several times transversely of said grooves, each said girder having an inner supporting wall and an outer supporting wall with three transverse bend lines lying in the opposite border zones of said sheet disposed at three corners of the girder, recesses formed in said sheet for each said groove, each said recess being shaped in the general configuration of the groove with one such recess being disposed along each said bend line to accommodate the groove configuration in said folded hollow girder, and slots cut in said sheet associated with the ends of each said recess to accommodate folding said profiled sheet into said girders.

2. A pallet as defined in claim 1 characterized in that said grooves in said profiled metal sheet have a U or trapezoidal shape.

3. A pallet as defined in claim 1 characterized in that said recesses have a rectangular form with one longitudinal side thereof extending along a bending line, and said slots extend both said one longitudinal side and one short side of each said rectangular form recesses.

4. A pallet as defined in claim 1 characterized in that said recesses have a rectangular form extending parallel to said bend lines, and said slots are cut with a roof-shaped cutout at each end of each said rectangular form recess to define the required stop angle for abutting the edges in folding said profiled sheet into said girders.

5. A pallet as defined in claim 1 characterized in that each of said folded hollow girders is formed to occupy one-third of the total width of the pallet loading area.

* * * * *